US005460346A

United States Patent [19]

Hirsch

[11] Patent Number: 5,460,346

[45] Date of Patent: Oct. 24, 1995

[54] ARTICLE HOLDER

[76] Inventor: Nathan Hirsch, Monsey, N.Y. 10952

[21] Appl. No.: 131,848

[22] Filed: Oct. 5, 1993

[51] Int. Cl.[6] ..... A47B 96/06

[52] U.S. Cl. ..... 248/229.13; 24/11 HC; 224/272; 224/224.7; 224/231.51; 248/316.1; 362/190; 362/191; 403/329

[58] Field of Search ..... 248/229, 221.3, 248/222.1, 316.1, 316.7, 298, 222.4, 223.1, 223.2, 224.3, 224.4, 225.31, 231.5; 224/194, 269, 271, 272; 362/191, 190, 382; 403/329, 326; 24/11 R, 11 F, 11 HC, 339, 3.11

[56] References Cited

U.S. PATENT DOCUMENTS

| | | | |
|---|---|---|---|
| 910,189 | 1/1909 | Fox | 248/299 X |
| 1,222,458 | 4/1917 | Peterson | 248/316.7 |
| 1,362,432 | 12/1920 | Masters | 248/229 |
| 1,537,772 | 5/1925 | Hitzler | 248/229 |
| 1,774,775 | 9/1930 | Weitz, Jr. | 248/229 |
| 2,506,685 | 5/1950 | Sadloski et al. . | |
| 2,520,725 | 8/1950 | Judd | 403/326 X |
| 2,524,173 | 10/1950 | Peterson . | |
| 2,585,592 | 2/1952 | Sears . | |
| 2,638,297 | 5/1953 | Weinberger . | |
| 3,023,306 | 2/1962 | Kester . | |
| 3,227,948 | 1/1966 | Cheshire . | |
| 3,550,824 | 12/1970 | Bohanski . | |
| 4,040,547 | 8/1977 | Dickey | 248/229 X |
| 4,214,688 | 7/1980 | Griffin . | |
| 4,406,040 | 9/1983 | Cannone . | |
| 4,424,923 | 1/1984 | Bingham . | |
| 4,485,946 | 12/1984 | Liautaud . | |
| 4,528,622 | 7/1985 | Bacevius . | |
| 4,678,153 | 7/1987 | Maddock et al. | 248/229 |
| 4,866,816 | 9/1989 | Caveney | 248/74.3 X |
| 4,883,290 | 11/1989 | Landa . | |
| 4,895,329 | 1/1990 | Sloan . | |
| 4,897,768 | 1/1990 | Thul . | |
| 4,970,631 | 11/1990 | Marshall . | |
| 5,039,181 | 8/1991 | Lautenschlager | 248/298 |
| 5,103,384 | 4/1992 | Drohan . | |

FOREIGN PATENT DOCUMENTS

| | | | |
|---|---|---|---|
| 11086 | of 1887 | United Kingdom | 248/298.1 |

*Primary Examiner*—Ramon O. Ramirez
*Assistant Examiner*—Korie H. Chan
*Attorney, Agent, or Firm*—Pennie & Edmonds

[57] ABSTRACT

The present article holder comprises a dual purpose clip which is designed to attach to an article such as a flashlight, a clip attachment that locks onto the clip, and a clamp for attaching to a fixture or clothing. The clip is provided with a shank portion that may be used to clip onto a shirt pocket or like, much in the manner that a conventional pen with a clip is held to a clothing. The attachment is rotatably connected to the clamp so as to permit the attachment to be positioned relative to the clamp. The attachment permits the clip to be removably attached thereto with a locking feature. The end of the shank is provided with a curved enlarged head which cooperate with slots formed at the opposed longitudinal ends of the attachment. The slots and the head cooperate to releasably lock the clip thereunto.

19 Claims, 5 Drawing Sheets

ARTICLE HOLDER

BACKGROUND

Many different types of holders for articles, such as flashlights, use a clamp or the like to attach the article to clothing. Of course, a large variety of fixed supports have been known and used over the years. In the past, article holders have invariably used a clip or clamp-like holder to hold the article, such as a flashlight. In turn, the clip or clamp-like holder itself would be attached to a relatively stable or fixed article, such as the side of a hat, a belt, or a part of an article of clothing, furniture, etc., by another clamping means, such as an alligator clip.

For example, in U.S. Pat. No. 4,406,040, issued to Cannone, a flashlight holder comprises a clip for attaching to a brim of a hat, and an expandable strap for holding a flashlight to the clip. In U.S. Pat. No. 5,103,384, issued to Drohan, a flashlight holder comprises a clamp for holding to a support element, a flexible metal cable attached to the clamp at one end thereof, and a flexible strap for clamping to a flashlight is attached to the other end of the metal cable via a ball-and-socket joint.

In another type of flashlight holder, exemplified in U.S. Pat. No. 4,970,631, issued to Marshall, VELCRO is used to attach the flashlight to a headband. In U.S. Pat. No. 2,638,297 issued to Weinberger, the article holder comprises a U-shaped frame with a pivotable clip for holding a flashlight mounted to the free ends of the U-shaped frame. The clip is pivotable relative to the frame for positioning the flashlight that is attached to the clip. The frame itself can be removably mounted to a support structure via a conventional hanger arrangement.

In U.S. Pat. No. 4,214,688, which issued to Griffin, Jr., the article holder comprises a first clip for holding a flashlight. The first clip is resiliently attached to a second clip which, in turn, can be attached to a belt or the like. The second clip, alternatively, may be attached to a wall or the like via a clip holder which provides a belt-like structure for holding the second clip.

In these prior article holders, the clip for holding the flashlight is either integrally formed with another clip, as disclosed in U.S. Pat. Nos. 4,406,040; 5,103,384; 4,970,631; and 4,214,688, or is removably mounted to another clip, as disclosed in U.S. Pat. No. 2,638,297. In the prior integrally mounted clip type, the drawback is that the clip that holds the flashlight cannot be removed from the clip that clamps onto a fixture or clothing. In the prior holders that use a removably mounted type of clip, the clip for holding the flashlight is complex as the clip is permanently mounted to the U-shaped frame. The U-shaped frame that pivotally holds the flashlight clip is removable. Accordingly, the clip and the U-shaped frame are both detached from the second clip.

SUMMARY OF THE INVENTION

An object of the present invention is to provide an article holder, such as for a flashlight or the like, with a clip that is removable from the clamp portion that attaches to a fixture or to clothing.

Another object of the present invention is to provide a holder which enables a user to have hands-free use of a flashlight. The flashlight can be quickly and easily inserted into the holder, and upon insertion, is fixedly and firmly locked into the holder. At the same time, the holder is fully rotatable about 360° in order to enable the accurate and firm positioning of the flashlight. Furthermore, the invention provides for the easy removal of the flashlight from its locked position in the holder. These objectives have not been practically or effectively achieved by the prior-art holders. In fact, the flashlight holders which permit a degree of retention or gripping, such as those shown in the U.S. Pat. Nos. 4,970,631 and 2,638,297, are not readily capable of one-handed insertion and/or removal of the flashlight. Moreover, the operation of the prior-art devices is to be contrasted with the present invention, wherein the flashlight can be inserted or removed from its holder by an easy, one-hand operation. In addition, the invention provides for the flashlight to be fixedly locked in place upon insertion into a holder, and to be easily removable from the locked position in the holder.

Specifically, the present article holder comprises a dual purpose clip which is designed to attach to an article such as a flashlight, a clip attaching means that locks onto the clip, and a clamp for attaching to a fixture or clothing. The clip is provided with a shank portion that may be used to clip onto a shirt pocket or the like, much in the manner that a conventional pen with a clip is held to a clothing. The attaching means is rotatably connected to the clamp so as to permit the attaching means to be positioned relative to the clamp. The attaching means permits the clip to be removably attached thereto with a locking feature. More specifically, the attaching means is provided with a proximal end at which the shank portion of the clip is inserted and a distal end, at which the end of the shank portion is exited. The distal end and the proximal end are located at the opposite longitudinal ends of the attaching means. A pair of opposed and axially aligned first slots are formed at the distal and proximal ends.

The distal end of the attaching means is further provided with another slot contiguous with the first slot formed thereat and which is narrower in dimension than said first slot. The end of the shank portion has a curved enlarged head that cooperates with the narrower slot to lock the clip to the attaching means. Specifically, both of the first slots formed in the distal and proximal ends permit the head to pass through, but the narrower slot formed in the distal end permits only the shank portion to pass therethrough. The clip is biased to urge the head and the shank portion to engage the narrower slot once the clip is fully engaged with the attaching means. Due to the enlarged head and the curvature thereof, the head can always pass through the first slot in the distal end. However, once the head completely passes through the first slot in the distal end, the biasing of the shank portion toward the narrower slot forces the shank portion into the adjacent and continuous narrower slot. As the narrower slot permits the shank portion to pass therethrough but not the head, the clip cannot be pulled apart from the attaching means.

To remove the clip from the attaching means, the head is pushed toward the first slot, at which point the clip is unlocked, and further pushed into the attaching means, and pulled away from the attaching means.

As a result of this unique invention, the article-holding clip which receives the body of a flashlight can accommodate different sizes of flashlights. The shank portion of the clip, however, will remain the same regardless of the size of the holding clip. In this way, the same attaching means, or holder, can be used regardless of the diameter of the flashlight.

The clamp is preferably any conventional type of clamp for attaching to clothing or fixed object.

DETAILED DESCRIPTION OF THE DRAWINGS

Figure 1:
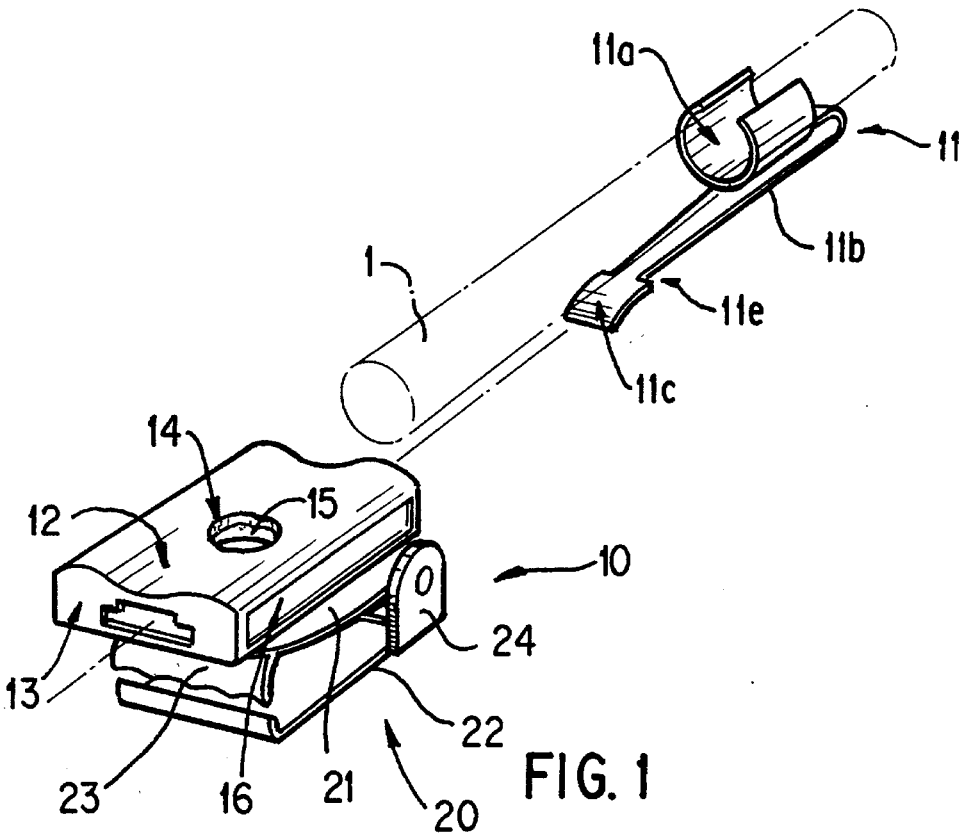
FIG. 1 is a perspective view of the first embodiment of the present article holder showing the article clip removed and the holding clamp in the closed position.

Two specific embodiments of the present invention are shown in the drawings. For convenience, the same or equivalent elements of the present invention illustrated in the drawings have been identified with same reference numerals.

The embodiments described herein have been contemplated for purposes of illustrating the principles of the present invention. Accordingly, the present invention is not to be limited solely to the exact configuration and construction as illustrated and set forth herein.

FIG. 1 shows a perspective view of the first embodiment of the present invention article holder 10, which comprises an article clip 11 that releasably attaches to an article such as a flashlight, an article clip attaching means 12 and a holding clamp 20.

Figure 6:
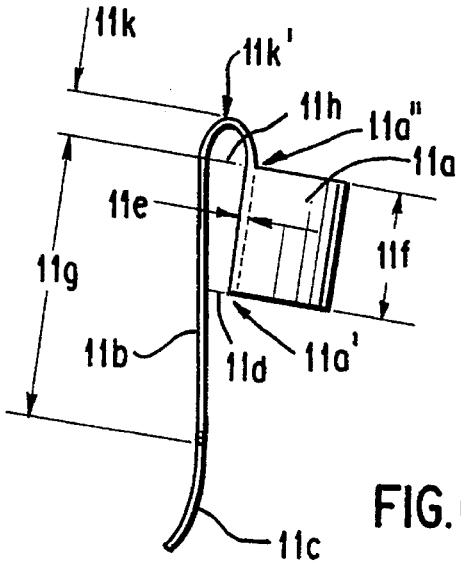
FIG. 6 is a side view of the article clip.
Figure 7:
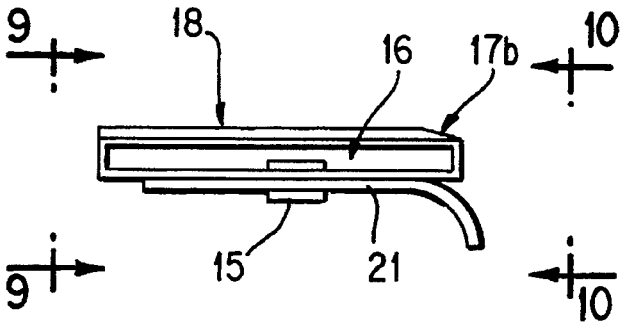
FIG. 7 is a side view of the article clip attaching means of the first embodiment.
Figure 8:
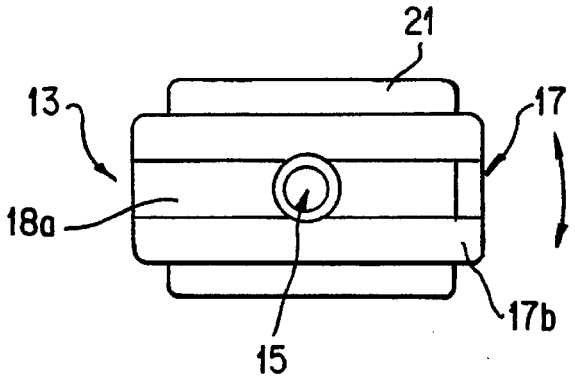
FIG. 8 is a top view of the article clip attaching means of the first embodiment.
Figure 9:
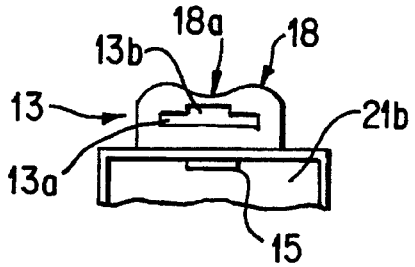
FIG. 9 is a left side view taken along line 9—9 of FIG. 7.
Figure 10:
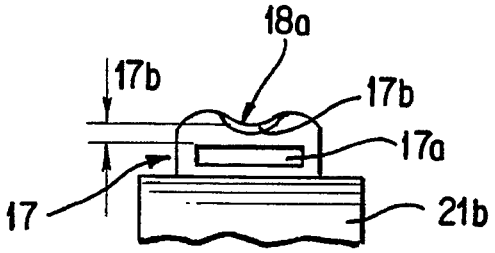
FIG. 10 is a right side view taken along line 10—10 of FIG. 7.
Figure 11:
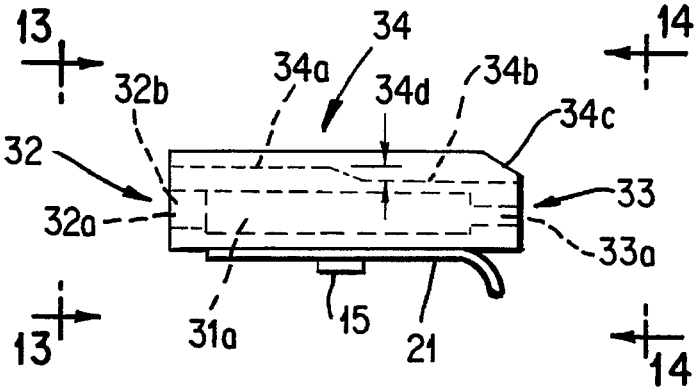
FIG. 11 is a side view of the article clip attaching means of the second embodiment.
Figure 12:
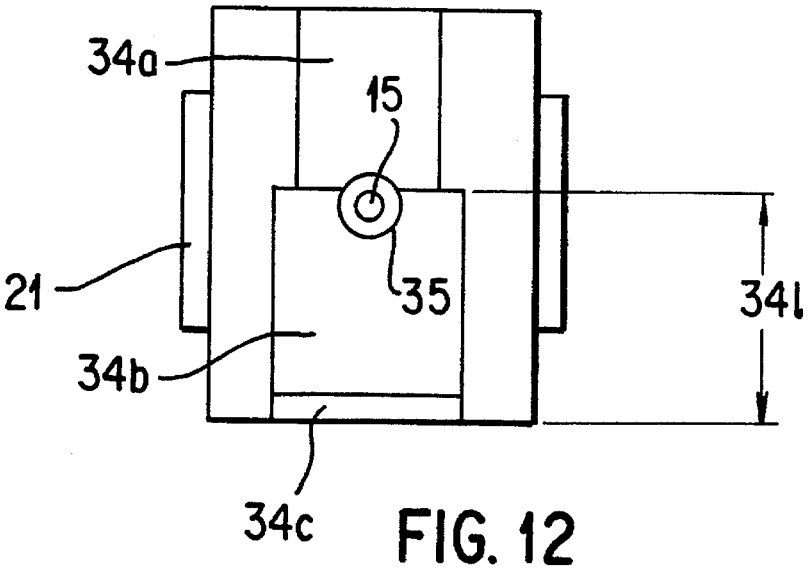
FIG. 12 is a top view of the article clip attaching means of the second embodiment.
Figure 13:
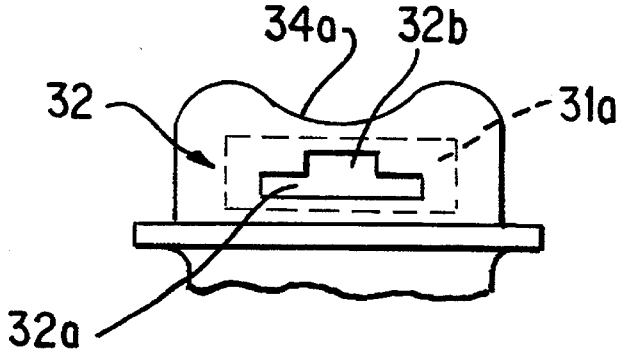
FIG. 13 is a left side view taken along line 13—13 of FIG. 11.
Figure 14:
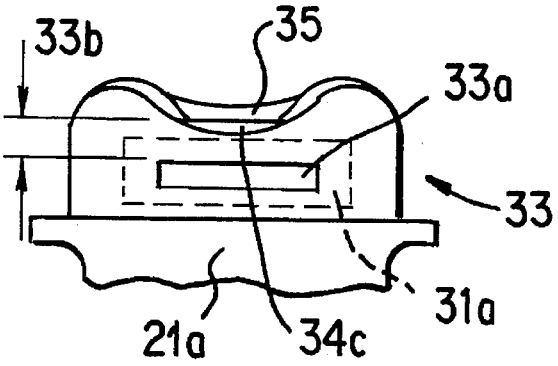
FIG. 14 is a right side view taken along line 14—14 of FIG. 11.

The side view of the article clip 11 is shown in FIG. 6. The clip 11 comprises a conventional resilient article holding portion 11*a* which releasably holds an article 1 such as a flashlight. In the present example, the article holding portion 11*a* has a substantially circular cross-section shape, "C"-like cross-section, to hold a cylindrical article. A resilient, spring-like shank portion 11*b* extends from one end of the holding portion 11*a* and loops around so that the shank portion 11*b* is adjacent to the holding portion, but not parallel to the side of the holding portion, with a variable spacing formed therebetween. The free end of the shank portion 11*b* is provided with an enlarged curved head 11*c* that curves away from the portion 11*a*. The head 11*c* and the shank portion is oar-like shaped. That is, the junction between the end of the shank portion 11*b* and the and head 11*c* has shoulders 11*c* formed by the differences in the widths thereof. The head 11*c* has a larger width than the end of the shank 11*b*. The dimensional difference at the junction between the head and the end provides a locking latch in conjunction with a slot 13*b* (32*b* in the second embodiment), formed in the attaching means 12 (31 in the second embodiment), which is discussed in detail below.

The attaching means 12 of the first embodiment is shown in FIGS. 1, 2 and 7–10. In the first embodiment, the attaching means 12 is made of thin walled material such as a sheet metal or polymer, which forms a box-like structure with two lateral opposing side 16 being opened or with no walls. The top side 18 is configured to accommodate cylindrical articles. That is, the top side is contoured or recessed substantially in its length to form a curved cradle-like recess 18*a* to permit cylindrical objects to rest thereon. The top side also has an opening 14 to permit a rivet-like 15 fastening means or a screw means to pass therethrough to permit pivotal attachment to the clamp 20, which is discussed further in detail below.

The other two opposed longitudinal ends 13 (distal end) and 17 (proximal end) of the attaching means are provided with slots 13*a,b* and 17*a*. The slots 17*a* and 13*a* are rectangularly shaped or any shape that is dimensioned to permit the head 11*c* and the rest of the shank portion 11*b* to pass therethrough. The slots 13*a* and 17*a* are substantially axially aligned. However, adjoining to the slot 13*a* and axially offset, there is provided another slot 13*b* which is formed continuously with the slot 13*a*, but with a smaller width than that of the head 11*c* of the clip. The slot 13*b* is formed between the top surface 18 and the slot 13*a*, and is dimensioned to permit the shank portion 11*b* to pass therethrough, but not the head 11*c*.

The spacing 11*d* between the leading edge 11*a'* of the portion 11*a* of the clip is preferably made smaller than the spacing 17*b* between the lowermost point of the cradle-like recess 18*a* and the uppermost part of the slot 17*a* so that the clip is frictionally engaged with the attaching means. The spacing 11*d* has to be forced to expand to permit the clip to be engaged with the attaching means. When the spacing 11*d* is enlarged, due to the resiliency of the clip, the shank portion is biased toward its neutral position or spacing. This biasing causes the clip to be frictionally engaged with the attaching means, while at the same time biasing the shank portion 11*b* into the narrower slot 13*b* or urging the shank portion 11*b* toward the top side 18. The length 11*g* of the shank portion 11*b* as measured from an intersection of the shank portion with an imaginary line 11*h* drawn from the trailing end 11*a"* of the holding portion 11*a* to the junction of the end of the shank portion and the head 11*c* is substantially equal to the length of the attaching means so that the head completely extends out of the distal end 13. The extra spacing 11*k* provided in the loop 11*k* ' enables the head 11*c* to completely pass through the distal end in case, due to manufacturing tolerance, should the length 11*g* of the shank portion be shorter than the length of the attaching means.

Figure 2:
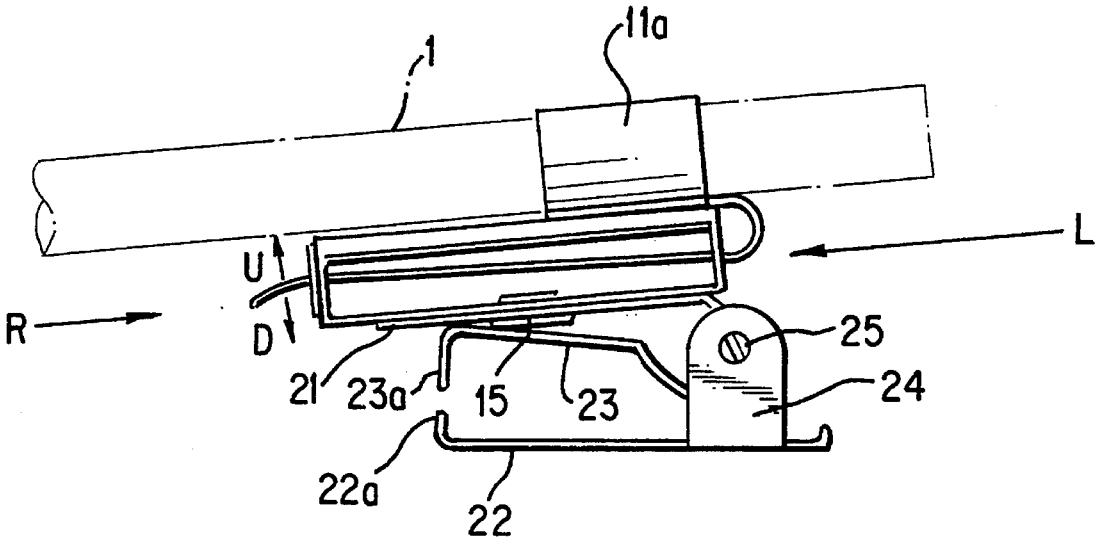
FIG. 2 is a side view of the first embodiment showing the article clip attached and the holding clamp in the closed position.
Figure 3:
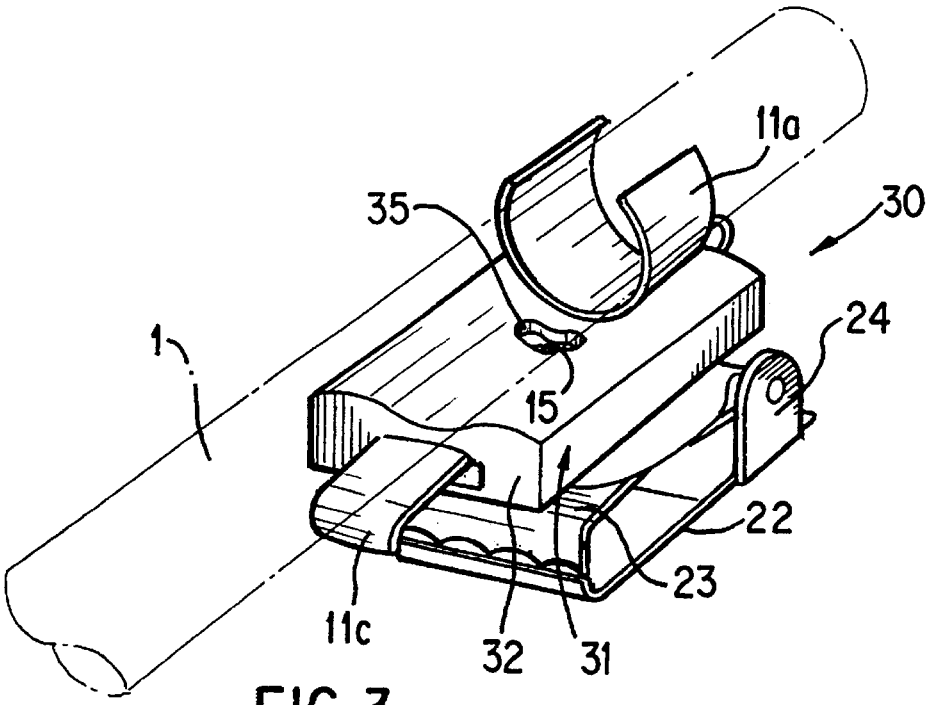
FIG. 3 is a perspective view of the second embodiment of the present article holder showing the article clip attached and the holding clamp in the closed position.

In operation, the head 11*c* of the clip is first inserted through the slot 17*a* formed in the proximal end 17 and pushed toward the distal end 13, in the direction L as shown in FIG. 2. As the leading portion 11*a'* abuts against the proximal end 17 and is forced in further by pushing the clip in the direction L, the holding portion 11*a* is forced to move away from the shank 11*b*, or vice-versa. In other words, the spacing 11*d* becomes larger to permit the holding portion 11*a* to engage with the top surface 18 of the attaching means, biasing the shank 11*b* and the head 11*c* toward the direction U as shown in FIG. 2. To ease the entry of the clip, the corner formed by the proximal end 17 and the top surface 18 is preferably provided with a bevel or angled 17*b*.

Even though the head 11*c* is urged toward the slot 13*b*, due to the curvature in the head 11*c* facing downwardly or away from the slot 13*b*, the head is always permitted to pass through the lower slot 13*a*. However, when the head 11*c* completely passes through the slot 13*a*, due to the upward bias, the shank portion 11*b* is urged into the slot 13*b*. As the slot 13*b* is dimensioned to pass the shank portion 11*b*, but not the head 11*c*, and the shank portion is biased toward the slot 13*b*, the shank portion enters into the slot 13*b* and remains therein. The clip 11 is securely locked to the attaching means 12 since the head 11*c* cannot pass through the slot 13*b*.

To detach or remove the clip 11 from the attaching means 12, the head 11*c* is pushed down in the direction D, toward the larger slot 13*a*, as shown in FIG. 2, at which the clip is unlocked, and further pushed toward the proximal end, in the direction L, and pulled away from the attaching means.

Figure 4:
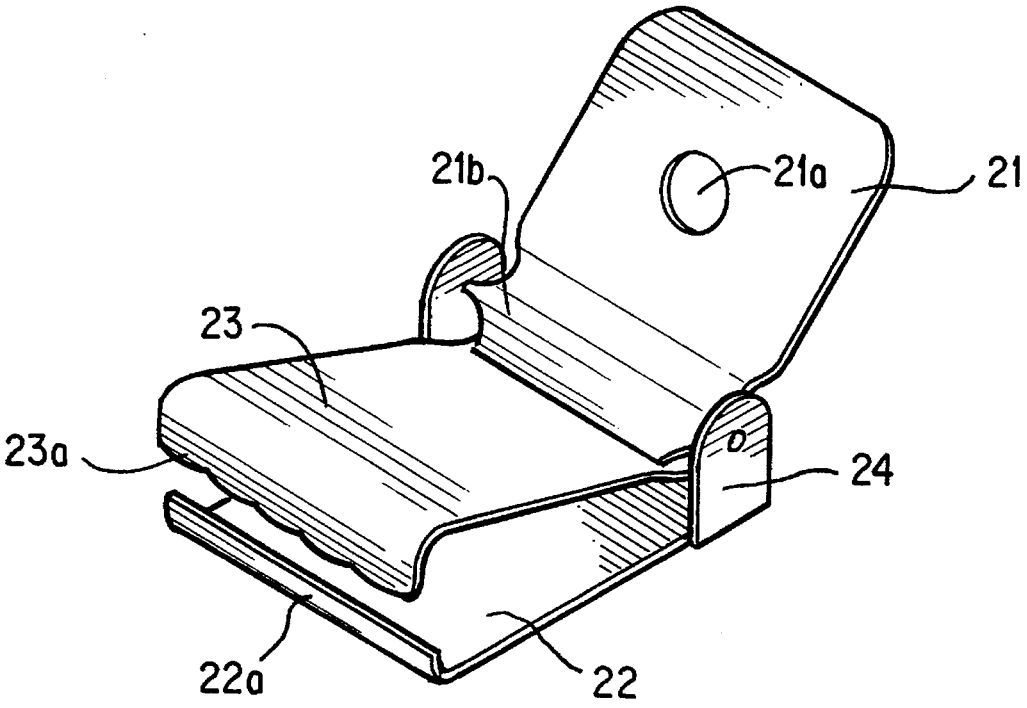
FIG. 4 is a perspective view of the holding clamp in an open position.
Figure 5:
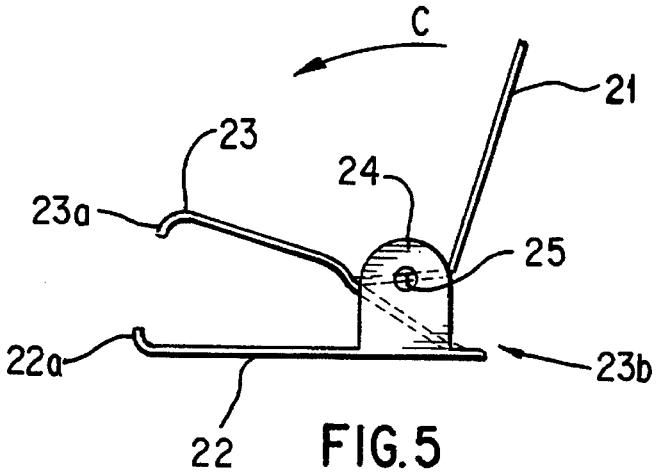
FIG. 5 is a side view of the holding clamp in the open position.

FIGS. 1, 2, 4 and 5 show the clamp 20 in details. The clamp 20 may be any type of clamp that can be attached to clothing or fixed objects. In the example shown in the present invention, the clamp 20 is based on a standard suspender adjusting clamp. The clamp 20 comprises a closing member 21, an upper clamp 23 and a lower clamp 22. The lower clamp has a pair of opposed upstanding flanges 24, each with an opening 25. The upper clamp 23 is made of resilient, spring like material which is fixedly attached at one end 23*b* via any conventional fixing means such as by welding, bolts, screws, etc., to the lower clamp and is biased in the open position as shown in FIGS. 4 and 5. The closing member 21 acts as lever to close the upper clamp 23 toward the lower clamp 22. Specifically, the closing member 21 is pivotally engaged with the lower clamp 22 via pins or shaft engaging with the openings 25. The closing member is substantially L-shaped in cross-section, with a shorter leg portion 21*b* angled with respect to the longer leg portion 21. By pivoting the closing member 21 about the openings 25 in the direction of arrow C shown in FIG. 5, the portion 21*b* engages the upper clamp 23 and urges the same toward the lower clamp 22 and maintains the upper clamp 23 in the closed position, as shown in FIGS. 1 and 2. The upper clamp 23 and the lower clamp 22 are preferably provided with teeth 23*a* and 22*a*, respectively to provide additional frictional engagement with clothing or the like.

The closing member 21 is provided with an opening 21*a* for permitting insertion of a conventional fastening means such as a screw or rivet for attaching the attaching means 12 thereto. The attaching means is attached to the closing member 21 via any conventional fastening means that would permit the attaching means to pivot or rotate with respect to the closing member, but provide enough friction to maintain its position. It is preferable to use a rivet 15 to hold the same and to provide with enough friction between the same to permit positioning of the attaching means about any of the 360° relative to the closing member 21. Alternatively, a screw/nut combination with a spring washer (not shown) can be used to hold the attaching means 12 to the closing member 21. The screw/nut combination permits the amount of pivotal frictional between the attaching means 12 and the closing member 21.

The second embodiment 30 of the present invention is identical to the first embodiment except for the attaching means. The same clip 11 and clamp 12 described above with respect to the first embodiment are also used in the second embodiment. Accordingly, description of the clip and clamp with respect to the second embodiment is omitted.

In the second embodiment, as shown in FIGS. 3 and 11–14, instead of a thin walled attaching means, a semisolid body attaching means 31 is used. The attaching means may be made of rubber, polymer, metal or any suitable material and has a hollow cavity 31*a* to permit the head 11*c* and the shank 11*b* to freely pass therethrough. Like the first embodiment, the top side 34 of the attaching means 31 is configured to accommodate cylindrical articles (the top side being contoured or recessed substantially in its length to form a curved cradle-like recess 34*a*, 34*b*) to permit cylindrical objects to rest thereon. However, in the second embodiment, the top side has two recesses having different contoured curves. The length 34*l* of the attaching means, which is at least the length 11*f* of the holding portion 11*a*, is formed with the recess 34*b* that has a flatter curvature than the recess 34*a*. The top side also has an opening 35 to permit a rivet-like 15 fastening means or a screw to pass therethrough for pivotally attaching to the clamp 22, as discussed above with respect to the first embodiment.

As in the first embodiment, the two opposed longitudinal ends 32 (distal end) and 33 (proximal end) of the attaching means are provided with slots 32*a,b* and 33*a*, which are substantially similar to the respective slots 13*a,b* and 17*a* of the first embodiment. Accordingly, the description with respect to the slots 32*a,b* and 33*a* is omitted.

The flatter curved recess 34*b* is positioned adjacent to the slot 33*a* formed in the proximal end 33 and the steeper flatter recess adjacent to the slots 32*a,b* of the distal end 32. Again, as in the first embodiment, the spacing 11*d* between the leading edge 11*a'* of the holding portion 11*a* of the clip is preferably made smaller than the spacing 33*b* between the lowermost point of the flatter curved recess 34*b* and the uppermost part of the proximal slot 33*a* to permit the clip to be biased into a secure engagement with the attaching means. Note that the flatter recess 34*b* sits lower or closer to the proximal slot 33*a* than the steeper recess 34*a* to the lower distal slot 32*a*.

The height spacing difference 34*d* between the recesses 34*a* and 34*b* are substantially equal to the thickness 11*e* of the holding portion 11*a* of the clip so that when the clip is engaged with the attaching means 31, the holding portion of the clip is substantially flush or collinear with the recess 34*a*.

The operation of the second embodiment is identical to the first embodiment. Accordingly, the operation of the second embodiment has been omitted. Again, to ease the entry of the clip into the attaching means, the junction between the proximal end 33 and the top surface 34 is preferably provided with a bevel or angled surface 34*c*.

Given the disclosure of the present invention, one versed in the art would readily appreciate the fact that there can be many modifications of the present invention not specifically depicted and described, but that are well within the scope and spirit of the disclosure set forth herein. Accordingly, all expedient modifications readily attainable by one versed in the art from the disclosure set forth herein that are well within the scope and spirit of the present invention are to be included as further embodiments of the present invention.

What is claimed is:

1. An article holder comprising:

an article holding member having an article holding portion for releasably holding an article and an elongated shank formed adjacent thereto, a substantially U-shaped curved portion joining said holding portion and said shank such that a spacing is formed between said shank and said holding portion, wherein said shank has a head portion formed at an end thereof, said head portion having a larger width than the width of the rest of said shank;

a clamp for attaching to a fixture or an object; and a connecting member attached to said clamp for releasably holding said article holding member, said connecting member having a slot extending substantially along the length thereof for receiving and holding said shank, the length of said shank being larger than the length of said slot such that said head portion extends beyond said connecting member when said article holding member is connected to said connecting member, said shank having biasing force, wherein said slot includes a keyed section which is automatically engaged by said shank via said biasing force to automatically lock said article holding member to said connecting member.

2. An article holder according to claim 1, wherein said said head portion is curved away from said article holding portion, with a convex side thereof facing said keyed section.

3. An article holder according to claim 2, wherein said connecting member includes a support for accommodating a cylindrical article, wherein said connecting member has a proximal end and a distal end, said keyed section having a smaller width than the width of said head portion and formed only on said distal end, said slot being dimensioned to permit said head portion to pass therethrough, wherein said shank automatically engages said keyed section upon a full insertion thereof into said connecting member to lock said article holding member thereto.

4. An article holder according to claim 3, wherein the curvature of said head portion enables said head portion to pass through said slot without engaging said keyed section, said shank being biased relative to said article holding portion to engage said key section once said head portion fully passes through said distal end.

5. An article holder according to claim 4, wherein said support is formed on a side of said connecting member between said distal and proximal ends of said connecting member, wherein a portion of said connecting member is sandwiched between said article holding portion and said shank, said article holding portion and said shank being biased toward each other to frictionally engage said article holding member to said connecting member.

6. An article holder according to claim 1, wherein said connecting member is pivotably attached to said clamp and being pivotable about 360° relative to said clamp.

7. An article holder comprising:

an article holding member having a resilient band portion for holding a cylindrical object and an elongated shank extending from said band, wherein said shank has a head portion formed at an end thereof, said head portion having a larger width than the width of the rest of said shank;

a clamp; and a connecting member attached to said clamp for releasably and lockably holding said article holding member, said connecting member having a proximal end and a distal end, a slot extending substantially along the length thereof and through said proximal and distal ends, wherein the length of said shank being larger than the length of said connecting member such that said head portion extends beyond said distal end when said shank is fully inserted into said connecting member, said shank having biasing force, wherein said slot includes a keyed section at said distal end which is automatically engaged by said shank via said biasing force when said shank is fully inserted to automatically lock and immobilize said article holding member to said connecting member.

8. An article holder according to claim 7, wherein said head portion is curved with a convex side thereof facing said keyed section.

9. An article holder according to claim 8, wherein said connecting member includes a support for accommodating a cylindrical article, said keyed section a smaller width than the width of said head portion, wherein said shank automatically engages said keyed section upon a full insertion thereof into said connecting member to lock said article holding member thereto.

10. An article holder according to claim 9, wherein the curvature of said head portion enables said head portion to pass through said slot but bypass said keyed section, said shank being biased relative to said resilient band portion to engage said keyed slot once said head portion fully passes through said distal end.

11. An article holder according to claim 7, wherein said connecting member is pivotably attached to said claim so as to be pivotable about 360° thereabout.

12. An article holder comprising:

a first resilient clip for holding an article, said first clip including a resilient band for releasably attaching to an article and an elongated shank extending from said band, wherein said shank has a head portion formed at an end thereof, said head portion having a larger width than the width of the rest of said shank;

a clamp for attaching to a fixture or an object; and a connector pivotally connected to said clamp so as to enable said connector to rotate and be maintained in any of the rotated position relative to said clamp, said connector having a distal end and a proximal end, a slot extending along the entire length thereof and through said proximal and distal ends, wherein the length of said shank being larger than the length of said connector such that said head portion extends beyond said distal end when said shank is fully inserted into said connector, said shank having biasing force, wherein said slot includes a keyed section at said distal end which is automatically engaged by said shank via said biasing force when said shank is fully inserted to automatically lock and immobilize said article holding member to said connecting member, said keyed section being contiguous to said slot.

13. An article holder according to claim 12, wherein said head portion is curved with a convex side thereof facing said keyed section.

14. An article holder according to claim 13, wherein said connector includes a support for accommodating a cylindrical article, said keyed section being smaller than the width of said head portion, wherein said shank automatically engages said keyed section upon a full insertion thereof into said connector to lock said article holding member thereto.

15. An article holder according to claim 14, wherein the curvature of said head portion enables said head portion to pass through said slot but bypass said keyed section, said shank being biased relative to said resilient band portion to engage said keyed slot once said head portion fully .passes through said distal end.

16. An article holder according to claim 14, wherein said support comprises a curved cradle for resting a cylindrical article.

17. An article holder according to claim 14, wherein said support comprises two curved cradle sections having two different curves formed collinearly along the longitudinal length of said connector.

18. An article holder according to claim 17, wherein a flatter curved cradle section is formed adjacent to said proximal end and a steeper curved cradle section is formed adjacent to said distal end, said flatter curved cradle section extending toward said distal end and said steeper curved cradle section extending toward said proximal end.

19. An article holder according to claim 12, wherein said connector is pivotable about 360° relative to said clamp.

* * * * *